US009831603B2

(12) United States Patent
Balest

(10) Patent No.: US 9,831,603 B2
(45) Date of Patent: Nov. 28, 2017

(54) DEVICE FOR STABILIZING A POWER CORD

(71) Applicant: Joseph Balest, Cortland, OH (US)

(72) Inventor: Joseph Balest, Cortland, OH (US)

( * ) Notice: Subject to any disclaimer, the term of this patent is extended or adjusted under 35 U.S.C. 154(b) by 0 days.

(21) Appl. No.: 15/281,689

(22) Filed: Sep. 30, 2016

(65) Prior Publication Data

US 2017/0149175 A1 May 25, 2017

Related U.S. Application Data

(60) Provisional application No. 62/258,009, filed on Nov. 20, 2015.

(51) Int. Cl.
*H01R 13/639* (2006.01)
*H01R 31/00* (2006.01)
*H01R 33/97* (2006.01)

(52) U.S. Cl.
CPC ..... *H01R 13/639* (2013.01); *H01R 31/00* (2013.01); *H01R 33/97* (2013.01)

(58) Field of Classification Search
CPC ..... H01R 33/97; H01R 31/00; H01R 13/639
See application file for complete search history.

(56) References Cited

U.S. PATENT DOCUMENTS 3,325,591 A * 6/1967 Wahl ..... H01R 4/5083 174/138 F
3,708,778 A * 1/1973 McKeever ..... H01R 13/6395 24/130
D269,065 S * 5/1983 Hough, Jr. ..... D8/356
4,618,200 A * 10/1986 Roberts ..... H01R 13/6395 439/147
5,575,677 A * 11/1996 Buckner ..... H01R 13/6395 439/147
6,213,808 B1 * 4/2001 Whatmore ..... H01R 13/516 439/417
6,375,487 B1 * 4/2002 Tennessen ..... H01R 13/5845 439/373
6,494,749 B1 * 12/2002 Chang ..... H01R 13/516 439/564
7,425,148 B1 * 9/2008 Allen ..... H01R 13/5804 439/369
7,470,141 B2 * 12/2008 Yoest ..... H01R 13/6392 439/369
7,559,788 B2 * 7/2009 Legg ..... H01R 13/6395 439/371
7,744,287 B2 * 6/2010 Lu ..... G02B 6/4439 385/135
7,938,667 B2 * 5/2011 Gonzalez ..... H01R 13/6395 439/345

(Continued)

*Primary Examiner* — Briggitte R Hammond
(74) *Attorney, Agent, or Firm* — Buckingham, Doolittle & Burroughs, LLC

(57) ABSTRACT

A device for stabilizing an electronic connection between a power cord and a mobile electronic device. The device comprises a housing comprising a top surface, a bottom surface, and an aperture. Both the top and the bottom surfaces each comprise a channel for accepting part of the power cord. The power cord penetrates the aperture and is held in place by the channels. The device reinforces the physical connection between the power cord and the mobile electronic device by providing additional lateral stability.

4 Claims, 7 Drawing Sheets

(56) References Cited

U.S. PATENT DOCUMENTS

| | | | | |
|---|---|---|---|---|
| 8,134,074 | B2 * | 3/2012 | Ong | H05K 7/1421 174/135 |
| 8,337,236 | B2 * | 12/2012 | Shu | H01R 13/6395 439/369 |
| 8,613,629 | B2 * | 12/2013 | Gong | H01R 13/6395 439/371 |
| 8,926,358 | B2 * | 1/2015 | Kuo | H01R 13/629 439/367 |
| 9,413,101 | B1 * | 8/2016 | Nooner | H01R 13/5208 |
| 2005/0191903 | A1 * | 9/2005 | Goodwin | H01R 13/52 439/578 |
| 2005/0250369 | A1 * | 11/2005 | Ferderer | H01R 13/627 439/352 |
| 2011/0256750 | A1 * | 10/2011 | Chen | H01R 13/506 439/345 |
| 2012/0211609 | A1 * | 8/2012 | Mandic | H02G 3/0443 248/65 |
| 2015/0018052 | A1 * | 1/2015 | Baschnagel | H04M 1/04 455/575.1 |

* cited by examiner

DEVICE FOR STABILIZING A POWER CORD

CROSS-REFERENCE

This application claims priority from Provisional Patent Application Ser. No. 62/258,009 filed Nov. 20, 2015.

FIELD OF THE INVENTION

This invention pertains generally to a device for securing and stabilizing a charging cord for an electronic device, and more particularly to a device that reduces stresses caused by inadvertent contact to the electronic device connected to a power cord by stabilizing the electronic connection to the electronic device while simultaneously providing additional structural support for the power cord.

BACKGROUND

Electronic devices such as desktop computers, laptop computers, tablets, smart phones, and other mobile electronic devices are configured to engage a wide variety of electronic adaptors so that they may be recharged. Many electronic adaptors are used to electrically and/or optically connect electronic devices to a power or data source. Power cords or charging cords are frequently used to charge most of these devices. Typically, one end of the power cord comprising a transformer is coupled to an alternating current power source transforming the power to direct current which is transmitted to the device through a second end of the cord which is temporarily coupled to the electronic device.

Additionally, AV cords, HDMI cables, USB cords, and the like are similarly used as adaptors between electronic devices to transfer or share data between the devices. These adaptors may be used for connectivity, communication, and transmitting electricity between the devices. Regardless of the precise structure of the electronic device, an electronic adaptor is typically received by a port in the electronic device configured for that purpose. The port receives the adaptor of a specific type designed for that particular device characteristically via a male/female type connection. Once the adaptor is received by the port, it is may easily be subjected to external forces such as inadvertent bumping, vibration, dropping, or similar unintended forces that may cause damage to the electrical connection or accidentally even disconnect the device from the power source.

Consequently, there exists a need for a durable stabilizing device that facilitates both the securing of the electrical connection between the device and the power source, and that protects the electrical adaptor and power cord from damage from external forces. As the portability of electronic devices increases, the frequency at which the power cords and electrical connections between the cords and the electronic devices become damaged continues to increase as well. Recurring bumps, vibrations, and other external forces may cause the adapters to torque, bend, or pull away from the ports. These forces may result from inadequate connections, attempting to disconnect the device from the cord by improperly twisting, pulling or wiggling the cord to dislodge the adaptor, or even by careless handling of a device plugged into a power source. Over time these forces can cause the adaptors and the cords to become worn or damaged to the point of inoperability.

SUMMARY

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a device for stabilizing an electronic charging cord connected to an electronic device. The device comprises a housing comprising a top, a bottom, a first and a second end, a pair of sides, and an aperture. The aperture penetrates the housing from the top through the bottom and is configured to allow a power cord to pass through the housing. The housing further comprises a first channel and a second channel for receiving and holding the power cord in place within the housing. The second end of the housing abuts a side of the electronic device when the power cord is plugged into the electronic device.

Furthermore, in a preferred embodiment of the invention the device further comprises a stabilizing component extending from the second end and the pair of sides for enhancing lateral stability. The stabilizing component comprises pair of side support elements, a top lip, and a bottom lip. The top lip extends from the top of the housing beyond the second end to engage a top of the tablet, and the bottom lip extends similarly beyond the second end out of the bottom of the housing to engage a bottom of the tablet. The top and the bottom lip provide additional stability perpendicularly to the lateral stability provided by the pair of wings.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
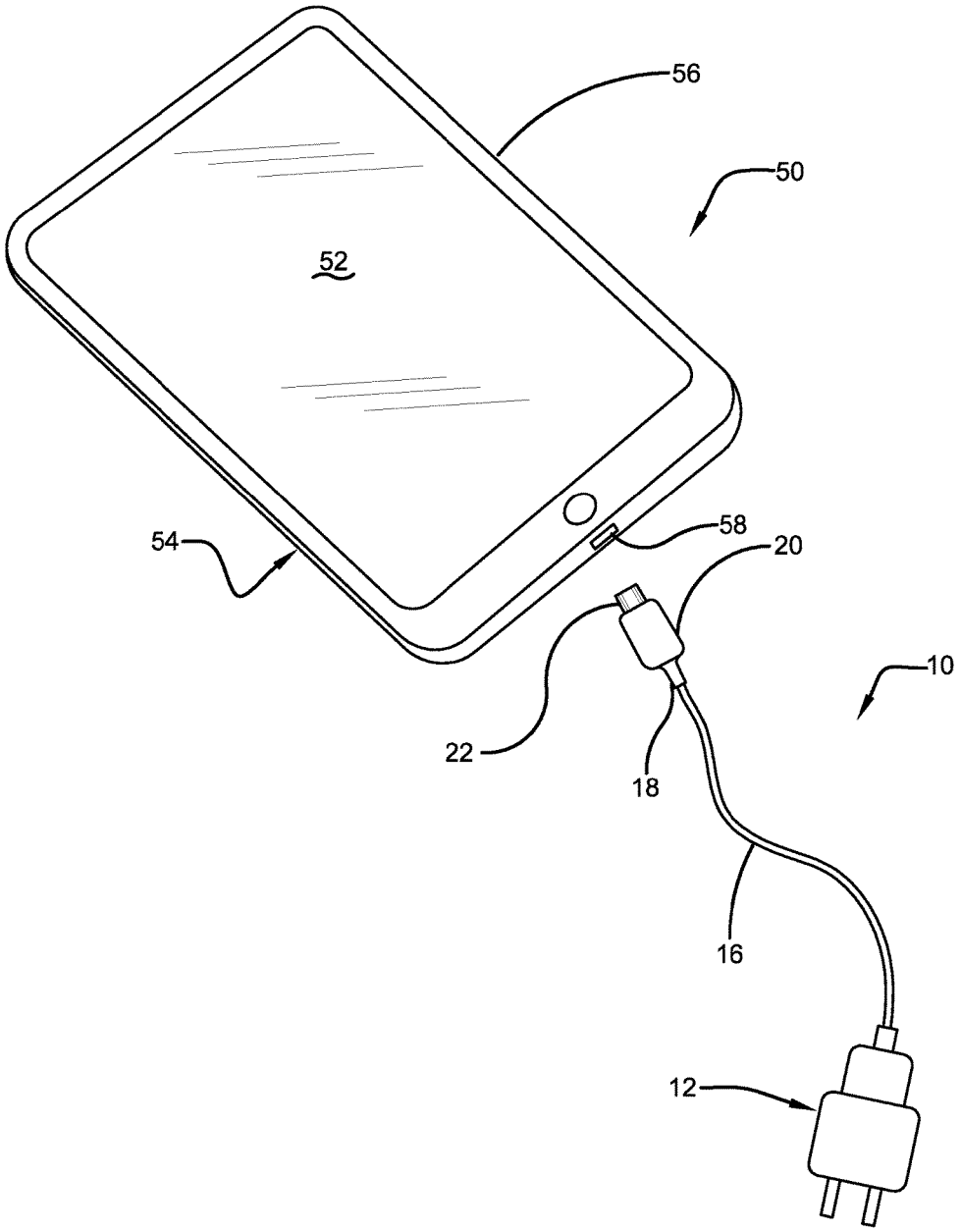
FIG. 1 illustrates a perspective view of a power cord and a mobile electronic device in accordance with the disclosed architecture.
Figure 2:
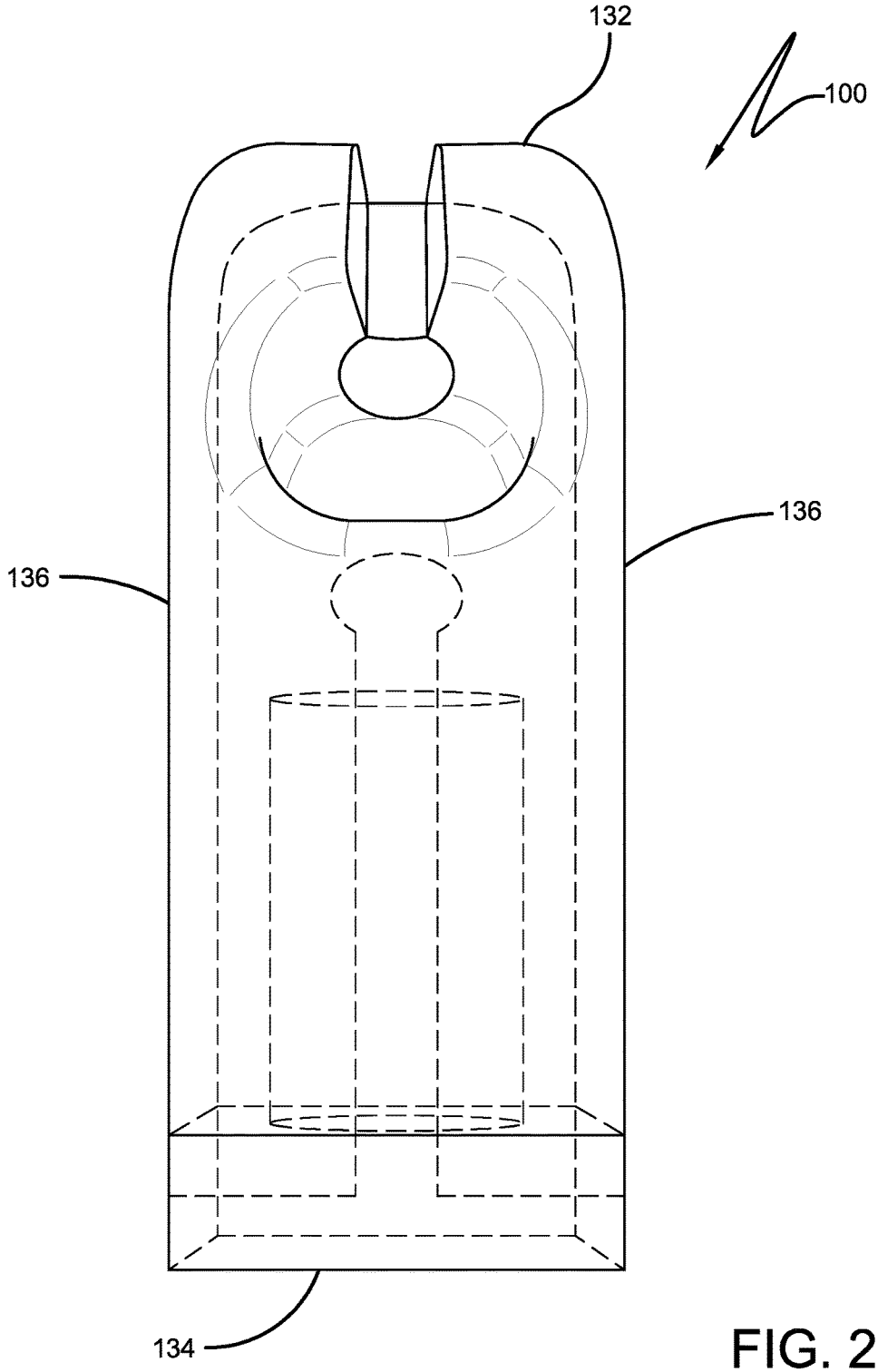
FIG. 2 illustrates a perspective view of a device for stabilizing a power cord in accordance with the disclosed architecture.
Figure 3:
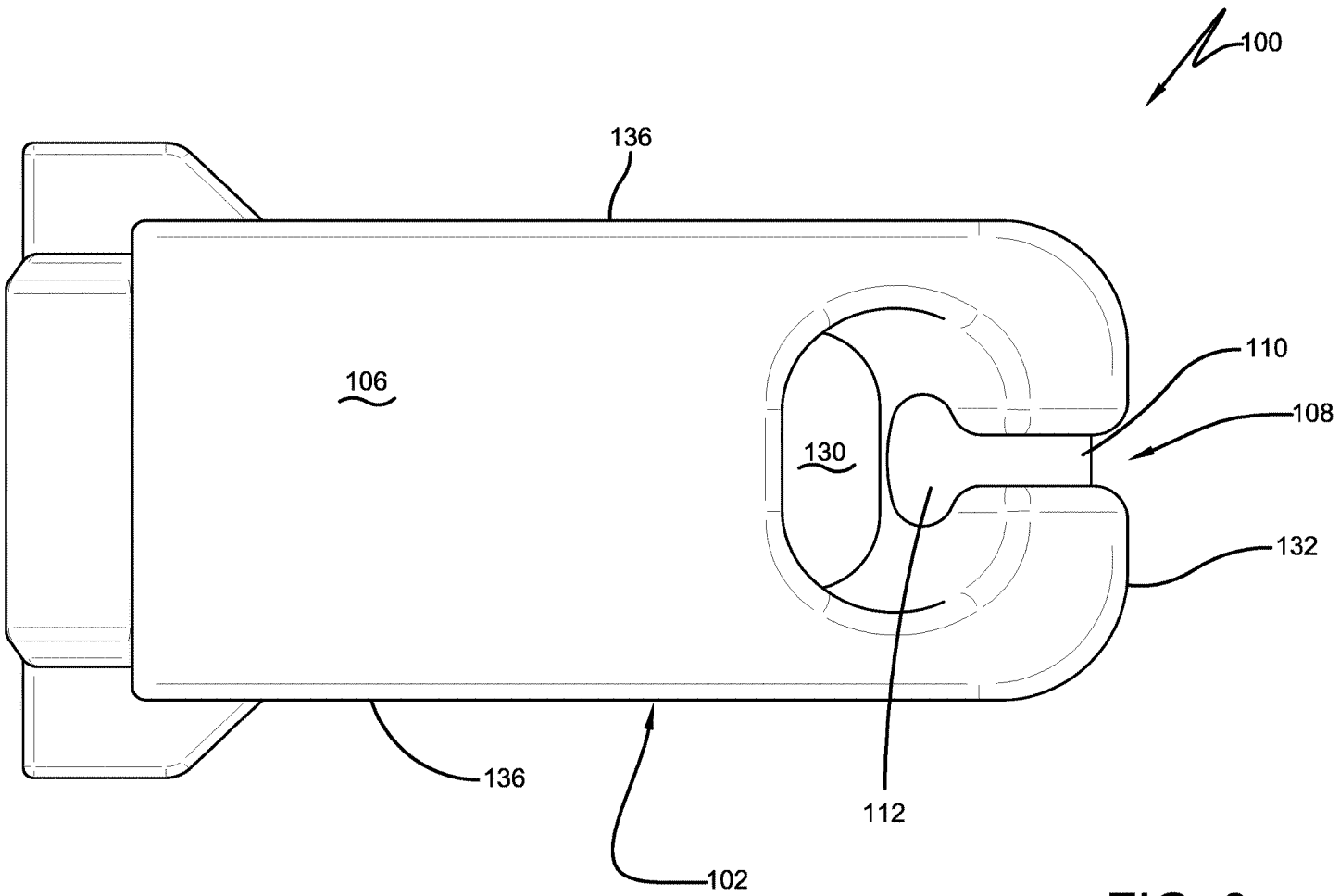
FIG. 3 illustrates a top view of the device for stabilizing a power cord in accordance with the disclosed architecture.
Figure 4:
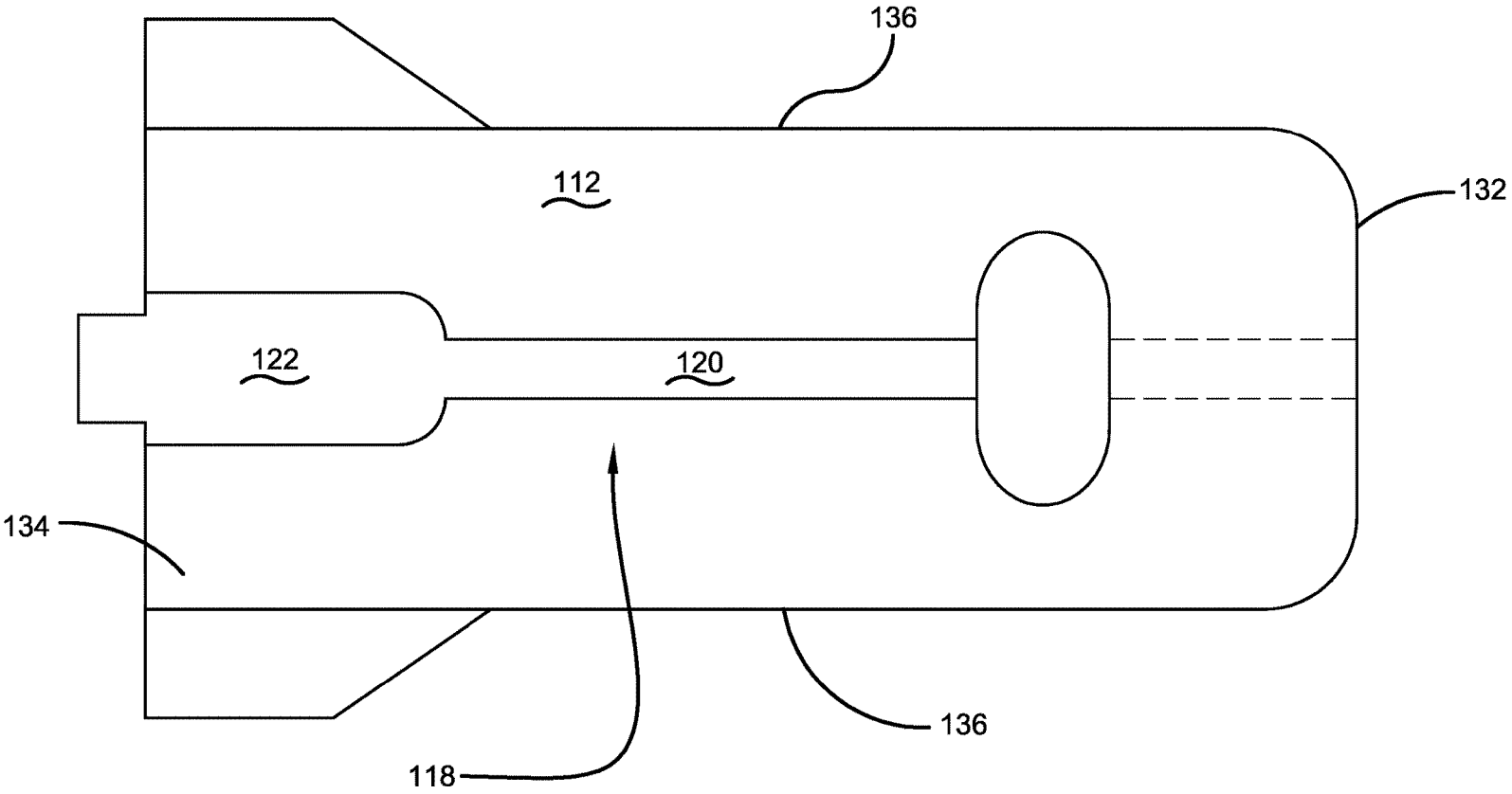
FIG. 4 illustrates a bottom view of the device for stabilizing a power cord in accordance with the disclosed architecture.
Figure 5:
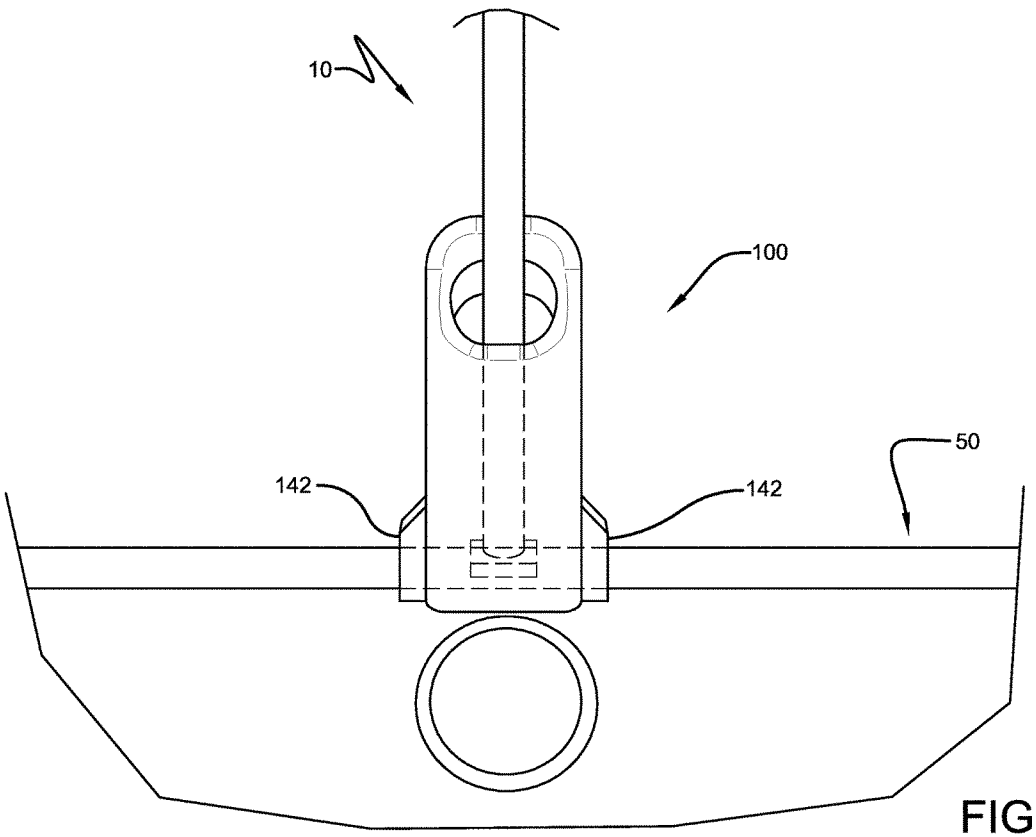
FIG. 5 illustrates a perspective view of the device for stabilizing a power cord engaging the power cord and the mobile electronic device in accordance with the disclosed architecture.
Figure 6:
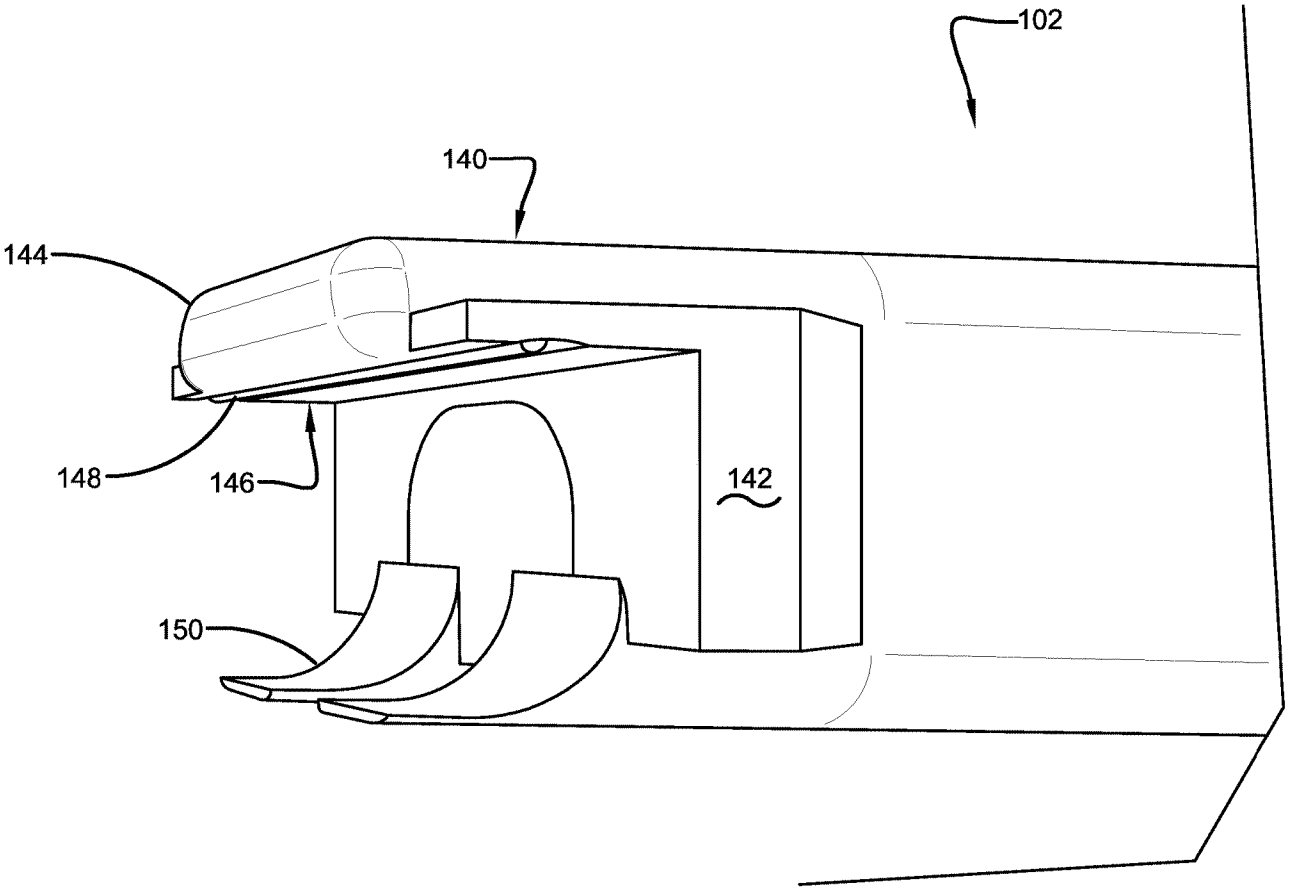
FIG. 6 illustrates an end view of a stabilizing component of the device for stabilizing a power cord in accordance with the disclosed architecture.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter. The invention relates generally to a device for stabilizing a charging cord and the electrical connection between the power cord and an electronic device.

Referring initially to the drawings, FIGS. 1-6 illustrate a device 100 for stabilizing and protecting a power cord 10 while connected to an electronic device 50. Additionally, when the power cord 10 is connected to the electronic device 50, the device 100 stabilizes an electrical connection between the power cord 10 and the electronic device 50 by resisting lateral forces to the electrical connection. The device 100 is usable in conjunction with any electronic device that uses a power cord to electrically charge it or to transfer data, such as but not limited to a desktop computer, a laptop computer, a tablet computer, an e-book reader, a phablet, a mobile phone, and the like. The typical electronic device 50 comprises a top 52, a bottom 54, a sidewall 56, and a female connection port 58. The power cord 10 compatible with the electronic device 50 may comprise a plug end 12, a cord portion 16, a bend restricting portion 18, a device connector housing 20, and a male connection port 22. One such example of the power cord 10 compatible with the device is a multi-pin cord such as an eight pin charging cord with a micro USB connector used to charge an iPhone 6® or an iPad Air® tablet.

The device 100 comprises a housing 102 comprising a top surface 106, a bottom surface 116, a first end 132, a second end 134, and a pair of sidewalls 136. The shape of the housing 102 is configurable to be compatible with the design of any electronic device known to one of skill in the art, such as but not limited to electronic devices produced by Apple®, Samsung®, Google®, and the like. Therefore, the shape of the housing 102 may be rectangular, ovular, cubical, semi-circular, trapezoidal, geometric, or any other shape as desired.

The housing 102 further comprises an aperture 130 formed between the top surface 106 and the bottom surface 116 of the housing 102 preferably positioned closer to the first end 132 than the second end 134. The aperture 130 completely penetrates the housing 102 from the top surface 106 through the bottom surface 116 and is configured to facilitate guiding the power cord 10 through the housing 102. The aperture 130 may comprise any shape and must be large enough to receive the power cord 10.

The top surface 106 comprises a first channel 108 and the bottom surface 116 comprises a second channel 118. The first channel 108 comprises a first portion 110 and a second portion 112. The first channel 108 is formed into the top surface 106 of the housing 102 running from the first end 132 into the aperture 130. The first portion 110 penetrates the first end 132 of the housing 102 and the second portion 112 penetrates the aperture 130. The first channel 108 is configured and dimensioned to receive and secure via friction the power cord 10. The second channel 118 is formed into the bottom surface 116 of the housing 102 running from the aperture 130 through the second end 134. The second channel 118 comprises a cord accepting portion 120 and a connector accepting portion 122. The cord accepting portion 120 of the second channel 118 extends out of the aperture 130 toward the second end 134 of the housing 102 and is configured and dimensioned to receive and secure via friction the bend restricting portion 18 of the power cord 10. The connector accepting portion 122 of the second channel 118 extends out of the cord accepting portion 120 and penetrates the second end 134 of the housing 102. The connector accepting portion 122 is configured and dimensioned to receive and secure via friction the connector housing 20 of the power cord 10. The dimensions of the cord accepting portion 120 and the connector accepting portion 122 are adaptable to be compatible with any electronic device's power cord as is known to one of skill in the art, such as but not limited to USB, USB 2.0. micro USB, lightning connectors, multi-pin connectors, and the like.

To use the device 100, a user threads or guides the cord portion 16 of the power cord 10 through the aperture 130 of the housing 102. The cord portion 16 is then pushed into the first channel 108 and secured within the first channel 106 via friction. The bend restricting portion 18 of the power cord 10 is similarly secured into the cord accepting portion 120 of the second channel 118, and the connector housing 20 is secured into the connector accepting portion 122 of the second channel 118 respectively so that the power cord 10 is essentially in-line and unbent when secured within the device 100. The connector housing 20 is housed within the connector accepting portion 122 so that is approximately flush with the second end 134 of the housing 102. This allows the male connection port 22 of the power cord 10 to extend out of the housing 102 for mating with the female connection port 58 of the electronic device 50.

Once a male/female electronic connection is accomplished, the second end 134 of the housing 102 substantially abuts the side wall 56 of the electronic device 50. This abutment increases the surface area between the power cord/device combination and the sidewall 56 of the electronic device 50. This increased surface area resists lateral or rocking type forces from improper or accidental pulling or twisting on the power cord 10, thereby protecting the electrical connection and preventing premature or accidental dislodgement of the male connection port 22 from the female connection port 58. The power cord 10 is also protected from these forces; and the cord portion 16, the bend restricting portion 18 and the connector housing 20 are held substantially in-line and are structurally supported by the housing 102, thereby protecting the power cord 10 from bending or other premature wear or damage. An additional benefit is that the device 100 resists inadvertent stresses to the electrical connection and to the power cord 10 that could loosen the female connection port 58 over time preventing a proper electrical connection. The device 100 also encourages proper disconnection of the power cord 10 forcing the user to pull the power cord 10 straight back out of the electronic device 50 as opposed to accidentally applying a sideways force that could cause damage.

The device 100 may be configured for use with a mobile electronic device encapsulated in a case. To accommodate the case, the connector accepting portion 122 of the second channel 118 would be configured so that a portion of the connector housing 20 of the power cord 10 extends out of the second channel 118 past the connector accepting portion 122 of the housing 102.

The device 100 may further comprise a stabilizing component 140 attached or coupled to second end 134 and the pair of sidewalls 136. The stabilizing component 140 comprises a pair of side support elements 142 that extend distally beyond the second end 134 of the housing 102 terminating at a point that is substantially flush with a level of a distal portion of the connector housing 20. The pair of side support elements 142 may be configured as a pair of wings to provide additional lateral stability along a side of the case while still allowing a proper electrical connection between the male connection port 22 and the female connection port 58. Each side support element 142 may be coupled, attached, or molded to the corresponding sidewall 136 of the housing 102 adjacent to the second end 134.

The device 100 may also be configured for use with an electronic tablet or larger electronic device. In this embodiment of the device 100, the pair of side support elements 142 terminate at a point that is substantially flush with the second end 134 of the housing 102. The stabilizing component 140 further comprises a top lip 144 and a bottom lip 150. The top lip 144 extends from the top surface 106 of the housing 102 out of the second end 134 and is configured to engage a front of the tablet. The top lip 144 comprises a top lip locking element 148 extending laterally or horizontally across a bottom of the top lip 146 between the first and the second sides. The top lip locking element 148 extends inward toward the bottom lip 150 and is configured to frictionally engage the front of the tablet for additional stability. The bottom lip 150 extends from the bottom surface 116 of the housing 102 out of the second end 134. The bottom lip 150 is shaped to engage a back of the tablet. The shape of the bottom lip 150 will be dependent on the shape of the bottom of the tablet. While not meant as a limitation, in one example the bottom lip 150 may be curved so that the bottom lip 150 fits snugly against a tablet having a curved side wall.

To use the device, the male connection port 22 engages the female connection port 58 as described supra. This permits the pair of side support elements 142 to substantially abut the side wall 56 of the tablet providing lateral stability. The top and the bottom lips 144 and 150 extend over and under the tablet respectively so that the top lip locking element 146 frictionally engages the front of the tablet and the bottom lip 150 engages the bottom of the tablet, thereby resisting any forces that are perpendicular to the lateral forces resisted by the pair of side support elements 142 engaging the side wall 56 of the tablet. As such, the electrical connection is reinforced along two axes as opposed to just a single axis in the lateral direction.

Figure 7A:
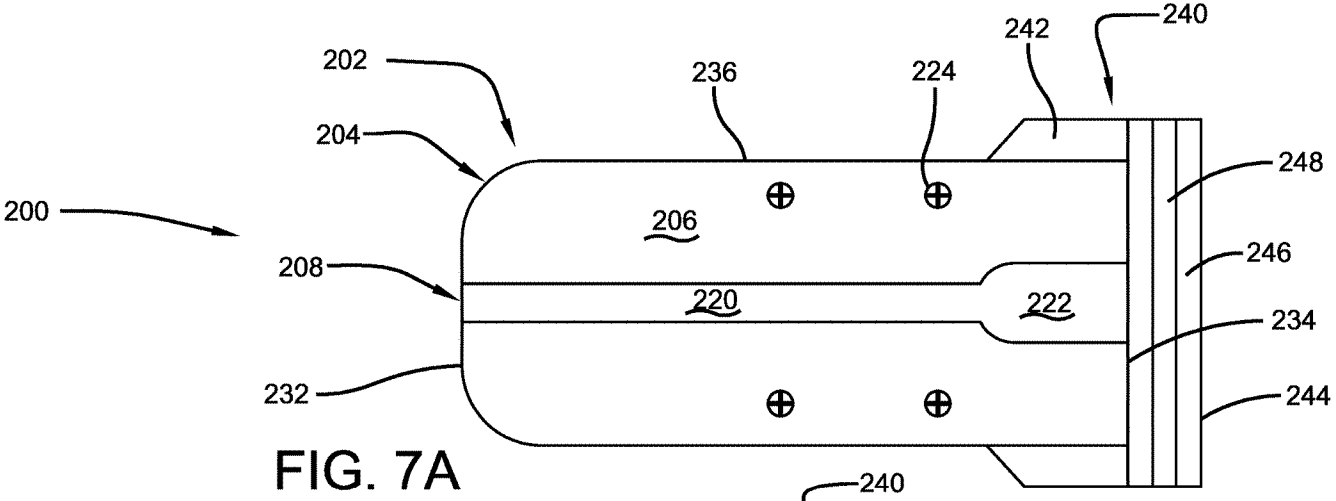
FIG. 7A illustrates a bottom view of a top component of a device for stabilizing a power cord in accordance with the disclosed architecture.
Figure 7B:
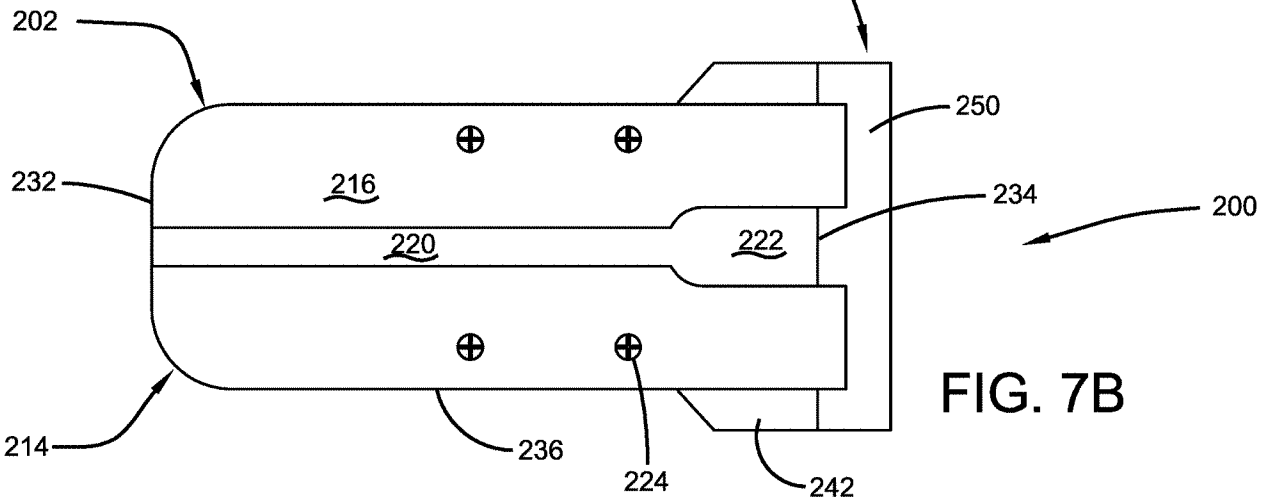
FIG. 7B illustrates a top view of a bottom component of the device for stabilizing a power cord for mating with the top component in accordance with the disclosed architecture.

In another embodiment as illustrated in FIGS. 7A and 7B, a device 200 comprises a housing 202 comprising a top component 204, a bottom component 214, a first end 232, a second end 234, and a plurality of sidewalls 236. While the housings of the embodiments described supra are constructed as a single unit, the inventor contemplates embodiments where the housing 202 is bisected with or without an aperture. This is advantageous as the power cord 10 would not need to be threaded thorough an aperture. The user could simply place the power cord 10 between the top component 204 and the bottom component 214 and connect them.

The top component 204 may engage the bottom component 214 by friction without the need for a mechanical fastener. Alternatively, the top component 204 and the bottom component 214 may be secured together by a plurality of component connection elements 224. The plurality of component connection elements may comprise snaps, clips, screws, and the like, or any other type of mechanical connection known to one of skill in the art.

The top component 204 comprises a top component inner surface 206 comprising a first channel 208. The bottom component 214 comprises a bottom component inner surface 216 comprising a second channel 218. The first channel 208 is cut or formed into the top component inner surface 206 so that it defines a space capable of accepting approximately half of a diameter of the portions of the power cord 10 that are engaged by the device 200. Similarly, the second channel 218 is cut or formed into the bottom component inner surface 216 so that it defines a space capable of accepting approximately half of a diameter of the portions of the power cord 10 that are engaged by the device 200. Both the first and the second channels 208, 218 are essentially mirror images of each other that completely transect the housing 202 running from the first end 232 through the second end 324. When the top component 204 engages the bottom component 214, the top component inner surface 206 abuts the bottom component inner surface 216 so that the first and the second channels 208, 218 align or are sandwiched together to form a space capable of accepting and engaging the power cord 10.

Both the first channel 208 and the second channel 218 each comprise a power cord accepting portion 220 and a power cord connector accepting portion 222. The power cord accepting portions 220 each penetrate the first end 232 of the housing 202. The power cord connector accepting portions 222 each penetrate the second end 234 of the housing 202. Both the power cord accepting portion 220 and the power cord connector accepting portion 222 of the first and the second channels 208, 218 are dimensioned to hold the cord portion 16 and the connector portion 20 of the power cord 10 in place via friction or compression.

The device 200 may further comprise a stabilizing component 240 attached or coupled to second end 234 and the plurality of sidewalls 236. The stabilizing component 240 comprises a pair of side support elements 242 that extend distally beyond the second end 234 of the housing 202 terminating at a point that is substantially flush with a level of a distal portion of the connector housing 20. The pair of side support elements 242 may be configured as a pair of wings to provide additional lateral stability along a side of the case while still allowing a proper electrical connection between the male connection port 22 and the female connection port 58. Each side support element 242 may be coupled, attached, or molded to at least one of the plurality of sidewalls 236 of the housing 202 adjacent to the second end 234.

The stabilizing component 240 may further comprise a top lip 244 and a bottom lip 250. The top lip 244 extends from the top component 204 of the housing 202 out of the second end 234 and is configured to engage a front of the electronic device 50. The top lip 244 comprises a top lip locking element 248 extending laterally or horizontally across a bottom of the top lip 246. The top lip locking element 248 extends inward toward the bottom lip 250 and is configured to frictionally engage the front of the electronic device 50 for additional stability. The bottom lip 250 extends from the bottom component 214 of the housing 202 out of the second end 234. The bottom lip 250 is shaped to engage a back of the electronic device 50. The shape of the bottom lip 250 will be dependent on the shape of the bottom of the electronic device 50.

The device 200 may further comprise a plurality of attachment elements (not shown). The attachment elements would fit over or otherwise engage the housing 202. The attachment elements may comprise designs such as but not limited to, football helmets, sports equipment, fictional characters, animals, structural shapes, vehicles, and the like, or any other desired design.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A device for stabilizing a power cord when connected to an electronic device comprising:

a housing comprising:

a first end, a second end, and a pair of sidewalls;

a top surface comprising a first channel formed within the top surface;

a bottom surface comprising a second channel formed within the bottom surface, the second channel comprising a power cord accepting portion for frictionally engaging the power cord; and an aperture formed between the top surface and the bottom surface that penetrates the housing; and a stabilizing component coupled to the second end and the pair of sidewalls of the housing the stabilizing component comprising:

a pair of side support elements each coupled to one of the pair of sidewalls of the housing adjacent to the second end;

a top lip extending from the top surface of the housing at the second end, wherein the top lip comprises a top lip locking element horizontally disposed across a bottom of the top lip; and a bottom lip extending from the bottom surface of the housing at the second end.

2. The device of claim 1, wherein the bottom lip is configured to engage a curved edge of the electronic device.

3. The device of claim 2, wherein the second channel further comprises a power cord connector accepting portion that penetrates the second end of the housing.

4. A device for stabilizing a power cord when connected to an electronic device comprising:

a housing comprising:

a first end, a second end, and a plurality of sidewalls;

a top component comprising:

a top component inner surface comprising a first channel formed within the top component inner surface running from the first end through the second end;

a bottom component attachable to the top component comprising:

a bottom component inner surface comprising a second channel formed within the bottom component inner surface running from the first end through the second end; and a stabilizing component coupled to the second end and the plurality of sidewalls of the housing; and wherein the top component and the bottom component are attached via a plurality of component connection elements; and wherein the first channel and the second channel comprise a power cord accepting portion that penetrates the first end of the housing and a power cord connector accepting portion that penetrates the second end of the housing for frictionally engaging the power cord; and wherein the stabilizing component comprises a pair of side support elements each coupled to at least one of the plurality of sidewalls of the housing adjacent to the second end; and wherein the stabilizing component further comprises a top lip extending from the top component of the housing at the second end, a top lip locking element horizontally disposed across a bottom of the top lip, and a bottom lip extending from the bottom component of the housing at the second end.

* * * * *